United States Patent [19]

Curtiss

[11] Patent Number: 4,964,630

[45] Date of Patent: Oct. 23, 1990

[54] EXERCISE DEVICE

[76] Inventor: Harold H. Curtiss, 851 Pool Rd., Biddeford, Me. 04005

[21] Appl. No.: 315,157

[22] Filed: Feb. 24, 1989

Related U.S. Application Data

[62] Division of Ser. No. 103,680, Oct. 2, 1987.

[51] Int. Cl.[5] ..... A63B 5/00; A63B 21/06

[52] U.S. Cl. ..... 272/93; 272/67; 272/117

[58] Field of Search ..... 272/67, 68, 93, 116, 272/117, 119, 127, 122; 128/26, 57; 401/198

[56] References Cited

U.S. PATENT DOCUMENTS

| | | | |
|---|---|---|---|
| 3,369,543 | 2/1968 | Ronco | 401/198 |
| 3,779,548 | 12/1973 | Sato | 272/67 |
| 4,218,057 | 8/1980 | Wilson | 272/119 |
| 4,369,967 | 1/1983 | Kimura | 272/119 |
| 4,384,714 | 5/1983 | Kimura | 272/119 |

*Primary Examiner*—Stephen R. Crow

*Attorney, Agent, or Firm*—Herbert L. Gatewood

[57] ABSTRACT

An exercise device is provided in the form of two elongated, cylindrical-shaped members for the exercise of one's hands and the fingers and thumb. The two elongated members are held in the palm of one's hand and are caused to rotate one about the other by the manipulation of the fingers and thumb against the elongated members.

8 Claims, 1 Drawing Sheet

EXERCISE DEVICE

This is a division of application Ser. No. 103,680, filed Oct. 2, 1987.

BACKGROUND OF THE INVENTION (a) Field of the Invention

This invention relates to exercise devices and, in particular, to such devices capable of being used in the palm of one's hand to exercise the hand and the fingers and thumb.

(b) Description of the Prior Art

The good working of one's fingers is not only desirable to all, it is essential to many professionals and technicians who need to be skillful with their fingers and hands, e.g., surgeons, pianists, ball players, typists and word processors.

Oftentimes, the working of one's fingers is reduced or made more difficult due to injury, such as broken bones, or surgery on one's hand, wrist or forearm, or because of arthritis.

In these and other such situations, it is sometimes desirable to provide exercises for the fingers and hand. As a result, over the years various exercise devices have been developed whereby one can exercise his/her fingers and hands. These devices find not only therapeutic uses but are useful, in general, to strengthen one's fingers and hand grip and to provide better manual dexterity. Exemplary of these prior art devices are those disclosed in U.S. Pat. Nos. 1,026,215; 3,779,548; 4,278,248; and 4,577,858, and in British Patent No. 550,961.

U.S. Pat. No. 1,026,215, which issued on May 14, 1912, discloses a device comprising the combination of a grip dumb-bell with a hand grip exerciser with a view to providing the desired weight, a spring member connecting the two with each other. Thus, when used as a hand exerciser, the device will cause an alternate tension and relaxation of the muscles of the hand, wrist and arm. The squeezing of the fingers on the handles of the hand exerciser, nevertheless, exercises only the flexors of the fingers. No other hand motion is provided, i.e., there is no range of motion provided for the fingers and thumb. As disclosed by the patentee, the dumb-bell is detachable from the device and can be used as a dumb-bell by itself, if desired. If more weight is desired, two dumb-bells can be connected together according to the patentee, and can readily be taken hold of in one hand by the user. Nevertheless, the two dumb-bells when used together are interlocked and are not capable of being rotated by the user one over the other.

U.S. Pat. No. 3,779,548 discloses a finger training apparatus. This apparatus comprises a grip portion to be held in the palm of one's hand, and a forked portion. The forked portion supports two elongated rollers in spaced-apart relationship to one another on the ends of each of which is located a gear, the two gears being in intermeshing engagement, one with the other. The peripheral surface of each of the rollers is provided with longitudinally extending grooves which facilitates engagement of the fingers with the rollers in use of the apparatus. Thus, this apparatus provides a limited range of motion. Nevertheless, the resistance and ability to vary resistance cannot be determined. The elongated rollers, moreover, are in fixed location relative to one another and cannot be rotated one over the other.

In U.S. Pat. No. 4,278,248 there is disclosed a rhythm indicating exercising device for use by those engaged in aggressive walking exercise. The device, in general, comprises a tubular member in the internal bore of which is located a weighted mass. The weighted mass is caused to hit the stop provided at the ends of the tubular member as one's arm changes its direction of swing while walking, causing an impact sound. Thus, the person is enabled to establish and maintain an appropriate rhythmic swing of the arms to coincide with the cadence of the footstep. In use of the device, as disclosed by the patentee, one such device is grasped in the hand, or preferably, a pair of the tubular members are held, one in each hand.

U.S. Pat. No. 4,577,858 discloses a fingertip exerciser comprising two balls each having a bore extending centrally therethrough and a connection inserted through the bores of the two balls and rotatably connecting the balls together. In use, the balls rotate on their own axis independent of one another and are incapable of being rotated one over the other.

British Patent No. 550,961 discloses improved grip dumb-bells whereby the resistance to grip may be varied. Thus, the dumb-bell disclosed comprises an interchangable core of a rigid or resilient substance, as desired, whereby the resistance to grip can be varied.

Other exercise devices known heretofore for use in one's hand are disclosed in *Black Belt,* July, 1986, at page 54, and in *Popular Mechanics,* November, 1983, at page 44. Both of these articles disclose spherical members or balls, to be grasped in the palm of one's hand, and to be rotated, or otherwise manipulated by the fingers.

SUMMARY OF THE INVENTION

It is a primary object of the invention to provide an exercise device for use in the palm of one's hand for exercising one's fingers and hand.

It is a further object of the invention to provide an exercise device that will be found useful in the exercise of the wrist and forearm muscles.

It is a further object of the invention to provide a device suitable for use in exercising one's fingers and hands that is of simple and economical construction.

A further object of the invention is to provide an exercise device that will be found useful for therapeutic purposes.

Another object of the invention is to provide an exercise device that will be found useful in improving the working of one's fingers and hands after injury thereto or surgery.

A still further object of the invention is to provide an exercise device that will be found useful in increasing the strength of one's fingers and improving manual dexterity.

These and other objects as will become clear after a reading of this disclosure are attained by the exercise device of this invention which comprises, in its most basic aspects, two elongated, cylindrical-shaped members, each of predetermined diameter, length, and weight, and each member having a smooth outer surface, these members capable of being held in the palm of one's hand and rotated one over the other with manipulation of the fingers and thumb.

Quite advantageously, the exercise device of this invention can provide a range of motion for all fingers at once, or it can be used to provide a range of motion for the thumb and any single digit, as desired. Thus, there is provided by the exercise device of my invention full range of motion for the finger flexors, abductors, adductors, and the thumb flexors, adductors, and opposing muscles of the thumb and fifth digit.

BRIEF DESCRIPTION OF THE DRAWING

The objects and advantages of my invention will become apparent to those skilled in the art when the following description and best modes contemplated for practice of the invention are read in conjunction with the accompanying drawing, in which.

DETAILED DESCRIPTION OF THE INVENTION AND THE PREFERRED EMBODIMENTS THEREOF

Figure 1:
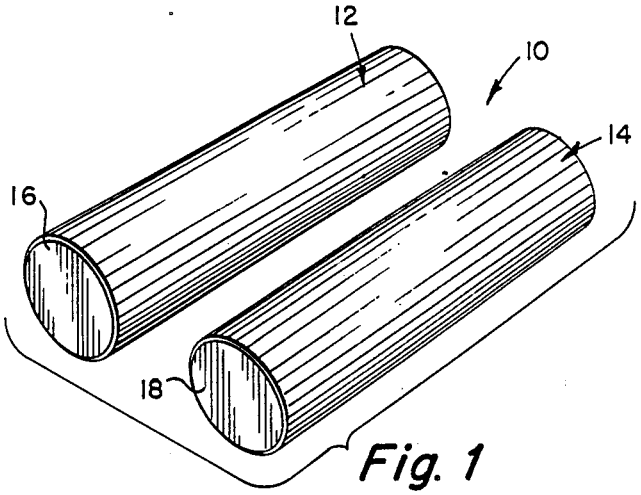
FIG. 1 is a view in perspective of two elongated members comprising the exercise device of the invention.

Referring now to the drawings, there is shown in FIG. 1 thereof an exercise device 10 comprising elongated members 12, 14, each of circular-shaped cross-section, and having smooth peripheral surfaces 16, 18, respectively. The two elongated members are matched pairs and only one of such members, elongated member 12, will be more fully described hereafter.

The diameter of elongated member 12 can vary somewhat, depending to a certain extent on the size of an intended user's hands. In general, it will be appreciated, that the larger the user's hands, the larger can be the diameter of the elongated member 12. Nevertheless, the diameter must be appropriate so that a user can grip the two such elongated members 12, 14 in the palm of his/her hand at one time, and still manipulate the fingers so as to rotate the elongated members one over the other. In general, the diameter of elongated member 12 can be from about ¼ inch to about 1 ½ inches, preferably about ½ inch. The diameter of the elongated member should not be less than about ¼ inch, except in the case where the user is a child, else the user will find it more difficult to rotate the one elongated member over the other.

The length of elongated member 12 should be, in general, from about four to six inches. Again, this can vary somewhat depending on the size of the hand of the end user. Nevertheless, it is preferred that the elongated member not be less than about three inches, as the shorter the elongated member is, the more difficult it is to manipulate two of them with the fingers in the manner disclosed hereinafter.

Elongated member 12 should have a weight of from about ½ ounce to about 2 pounds, preferably about 9 ounces; however, the weight of the elongated member in any particular case will depend not only upon the intended user, but also upon what one wants to accomplish with the exercise. For example, a person recovering from an injury, requiring little resistance to range of motion, would require a lighter weight set of hand exercisers according to the invention. An athlete, however, would need a heavier weight set. Where desired, a user can use elongated members of progressively increasing weight, in an exercise program. Nevertheless, the weight of the elongated members should not be more than about 4 pounds, as such will, in general, cause the user to tire, too rapidly.

The elongated members 12, 14 can be, in general, manufactured of various materials so long as the desired weight is provided. Thus, the elongated members can be manufactured from metal rods such as steel rods of the desired diameter, and cut to the desired length. Whatever the material of construction used, the elongated members of the invention preferably will be of material having a relatively low coefficient of friction and will be provided with a relatively smooth peripheral surface whereby the two members can readily be manipulated with the fingers, as later more fully disclosed, and rotated one over the other. It is desired also that the elongated members be of a non-rusting material so that the elongated members will not rust and the user does not get rust all over his/her hands. Importantly also, it is desired that the elongated members be of such material that in use, when rubbed one against the other, no static electricity is generated. Thus, where the elongated members are manufactured of conventional carbon steel rod, the steel rod can be chrome-plated to provide elongated members having not only a good appearance but also a smooth peripheral surface having a relatively low coefficient of friction, and non-rusting properties.

Figure 2:
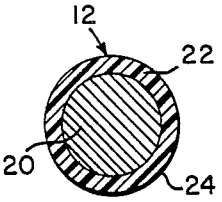
FIG. 2 is a view in cross-section of one elongated member comprising the exercise device according to another embodiment of the invention.

In another embodiment of the invention, as disclosed in FIG. 2, elongated rod 12 can comprise an elongated core member 20 and an elongated sleeve or sheath 22, coextensive in length with the length of core member 20, whereby to provide a cover thereover. If desired, however, the sleeve 22 can be provided with end caps FIG. 3 of the same diameter as the sleeve so that the ends of the core member are covered. The elongated sleeve can be manufactured of various plastic materials whereby to provide a smooth, outer peripheral surface and one having a low coefficient of friction. Such a sleeve will also result in no static electricity being manifested, when two elongated members are rubbed one against the other, during exercise. As examples of material suitable for this purpose, one may use polyvinyl chloride, chlorinated polyvinyl chloride, ABS, or any firm plastic material. Such materials can be readily extruded into a tube of the desired diameter, according to conventional techniques, and then cut to the desired length. The internal diameter of the plastic tube should be such, when compared to the diameter of the core member to provide a tight fit. It will be appreciated by those skilled in the art that, in some cases, the tube can be of slightly larger internal diameter than core member 20 and heat shrunk onto the core member thereby to provide intimate contact between the core member and sleeve.

The weight of the elongated member, in this embodiment of the exercise device 10 according to the invention, will be provided mostly by the elongated core member 20. Sleeve 22, on the other hand, provides the other requirements of the invention, i.e., an elongated member having a smooth peripheral surface and one of a low coefficient of friction. And such a sleeve will also provide that the elongated members are characterized by non-rusting properties and manifest no static electricity when rubbed against one another in performance of the finger/hand exercises.

Figure 3:
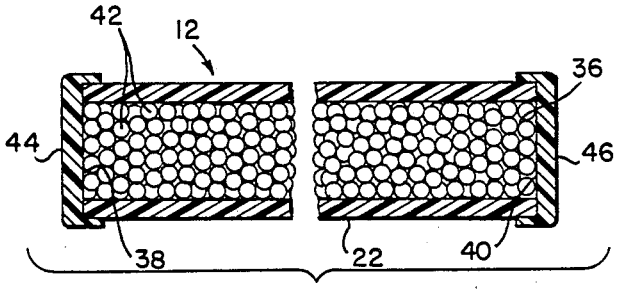
FIG. 3 is a sectional view in the longitudinal direction of another embodiment of the invention.

In a further aspect of this embodiment of the invention, the core member need not necessarily be of solid material. The core member can, if desired, comprise various particulate bearing material such as sand, lead shot, metal pellets, etc. Thus, the weight of the elongated members can be varied, as desired, depending upon the resistance to range of motion desired. A hollow tube might even be used in some cases of rehabilitation. Then, the tube could be filled with increasing weighted mass bearing material as the rehabilitation improves. Such as elongated member, according to the invention, is disclosed in FIG. 3. As shown in FIG. 3, elongated member 12 comprises an elongated sleeve or tubular-shaped member 22 which defines an elongated, hollow, internal core 36 and is defined by ends 38, 40. Particulate mass bearing material, e.g., lead shot 42, is provided in the core 36 in an amount to provide the desired weight. The particulate mass bearing material is contained within the core by end caps 44, 46, provided on the ends of the tubular-shaped member 22.

Figure 4:
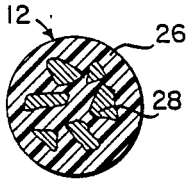
FIG. 4 is a view in cross-section of one of the elongated members of the exercise device according to a further embodiment of the invention.

Another embodiment of the invention is shown in FIG. 4 wherein elongated member 12 comprises an elongated, circular-shaped body member 26 having dispersed therein particles 28 of suitable weighted mass. The weighted mass particles can be of various materials provided the desired weight for the elongated member is obtained. Thus, these particles can be of metal, stone, sand, plastic pellets, or other conventional material used as fillers in plastic compositions. In manufacture of the elongated member 12, the weighted mass particles 28 can be compounded according to usual techniques with a suitable plastic material as earlier disclosed, and then extruded into a continuous rod, after which it is cut into the desired length.

Figure 5:
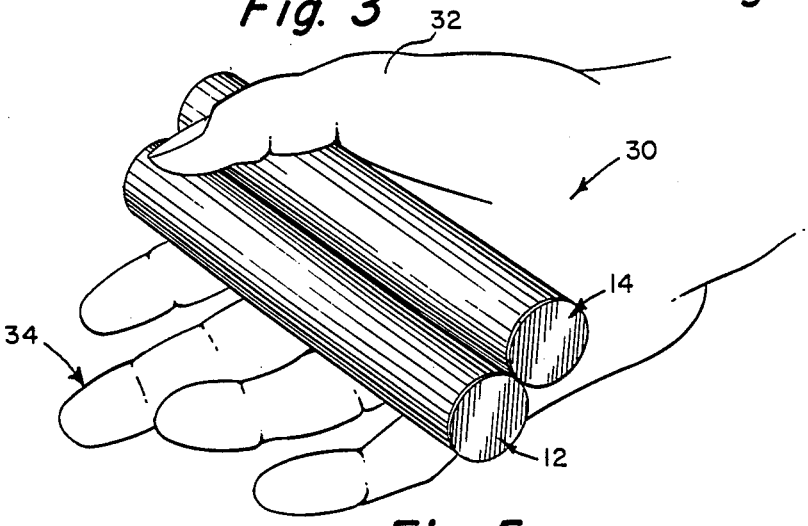
FIG. 5 is a view in perspective showing the use of an exercise device according to the invention.

Turning now to FIG. 5, the manner of use of the exercise device 10 of the invention is disclosed. As seen therein, the person exercising places elongated members 12, 14 in the palm of his/her hand 30 comprising thumb 32 and fingers 34. Then, the fingers 34 are manipulated to rotate the elongated members 12, 14 whereby one is rotated over the other.

Other modifications and changes, as will be understood, can be made in the invention and its form and construction without departing from the spirit and scope thereof. The embodiments disclosed herein are merely exemplary of the various modifications that the invention can take and the preferred practice thereof. It is not, however, desired to confine the invention to the exact construction and features shown and described herein, but it is desired to include all such as properly come within the spirit and scope of the invention disclosed.

What I claim is:

1. An exercise device suitable for use in the palm of one's hand and being capable of providing a full range of motion for the finger flexors, abductors, adductors, and the thumbs, adductors, and opposing muscles of the thumb and fifth digit comprising in combination two elongated, cylindrical-shaped members each of the same predetermined diameter, length, and weight, each said elongated member comprising an elongated tubular-shaped member defined by first and second ends and defining an elongated hollow internal core, particulate mass bearing material being provided within said internal core for providing weight to the said elongated member, and an end cap being provided on said elongated tubular-shaped member at each of its ends for containment of the particulate mass bearing material comprising the core, the said two elongated members being capable of being rotated one over the other by the manipulation of one's fingers against said elongated members, each of said tubular-shaped members being characterized by the inability to create static electricity when rotated one against the other, and each said tubular-shaped member comprising a non-rusting material having a smooth outer peripheral surface characterized by a relatively low coefficient of friction whereby to facilitate the rotation of one said elongated member against and over the other when the device is palmed in one's hand and used in the exercise of one's hand and fingers.

2. An exercise device according to claim 1 wherein the said non-rusting material is a suitable plastic material.

3. An exercise device according to claim 2 wherein the plastic material is a polyvinylchloride.

4. An exercise device according to claim 1 wherein each said elongated member is characterized by a diameter of from about ¼ inch to about 1 ½ inches, a length of from about three to six inches, and a weight of from about ½ ounce to about 2 lbs.

5. An exercise device according to claim 4 wherein each said elongated member has a diameter about ½", a length from about four to six inches, and a weight of about 9 ounces.

6. An exercise device according to claim 1 wherein the said particulate mass bearing material is sand.

7. An exercise device according to claim 1 wherein the said particulate mass bearing material is lead shot.

8. An exercise device according to claim 1 wherein the said particulate mass bearing material comprises metal pellets.

* * * * *